US012487001B2

(12) United States Patent
McFarland et al.

(10) Patent No.: US 12,487,001 B2
(45) Date of Patent: Dec. 2, 2025

(54) HEATER SYSTEMS

(71) Applicant: HotStart, Inc., Spokane, WA (US)

(72) Inventors: Christopher Michael McFarland, Spokane, WA (US); Benjamin J. Boyce, Spokane, WA (US); Bruce I. Nelson, Spokane, WA (US); Jody Wayne Gaylord, Post Falls, ID (US); Terry Judge, Spokane, WA (US)

(73) Assignee: HotStart, Inc., Spokane, WA (US)

( * ) Notice: Subject to any disclaimer, the term of this patent is extended or adjusted under 35 U.S.C. 154(b) by 173 days.

(21) Appl. No.: 18/354,499

(22) Filed: Jul. 18, 2023

(65) Prior Publication Data

US 2025/0027671 A1 Jan. 23, 2025

(51) Int. Cl.
*F24F 11/84* (2018.01)
*F24F 5/00* (2006.01)

(52) U.S. Cl.
CPC ..... *F24F 11/84* (2018.01); *F24F 5/001* (2013.01)

(58) Field of Classification Search
CPC .... F25B 30/02; F25B 41/26; F25B 2313/027; F25B 2313/0292; F25B 2313/0211; F25B 2313/0089; F25B 2400/01; F25B 2700/2116; F24F 1/84; F24F 5/001
See application file for complete search history.

(56) References Cited

U.S. PATENT DOCUMENTS 4,658,771 A 4/1987 Ravin
4,682,649 A 7/1987 Greer
5,429,179 A 7/1995 Klausing
5,438,846 A 8/1995 Datta
5,729,985 A 3/1998 Yoshihara et al.
2011/0214444 A1* 9/2011 Yoshii ..... F25B 47/006 62/160
2015/0159886 A1* 6/2015 Bush ..... F24D 17/0036 62/238.7

(Continued)

FOREIGN PATENT DOCUMENTS

CN 106321322 1/1900
CN 112665220 1/1900

(Continued)

OTHER PUBLICATIONS

Search Report and Written Opinion for International Application No. PCT/US24/38568, Dated Oct. 18, 2024, 9 pages.

*Primary Examiner* — Marc E Norman
(74) *Attorney, Agent, or Firm* — Lee & Hayes, P.C.

(57) ABSTRACT

A heater system for heating a piece of equipment. The heater system includes a reversing valve, a refrigerant compressor fluidly coupled to the reversing valve, an evaporator fluidly coupled to the condenser and the reversing valve, a condenser fluidly coupled to the reversing valve, the evaporator, and the piece of equipment, and a controller. The controller is configured to cause the reversing valve to operate between a first mode and a second mode. In the first mode, the piece of equipment utilizes a refrigerant, circulating in a first direction and heated via the evaporator, to keep the piece of equipment within a desired temperature range, and in the second mode, the evaporator utilizes the refrigerant, circulating in a second direction opposite the first direction and heated via the piece of equipment, to defrost the evaporator.

20 Claims, 5 Drawing Sheets

(56) References Cited

U.S. PATENT DOCUMENTS

| | | | | |
|---|---|---|---|---|
| 2016/0153343 | A1 | 6/2016 | Kakehashi et al. | |
| 2018/0312036 | A1* | 11/2018 | Kim | B60H 1/00921 |
| 2019/0366800 | A1 | 12/2019 | Durrani et al. | |
| 2022/0057122 | A1* | 2/2022 | Kasai | F25B 41/26 |

FOREIGN PATENT DOCUMENTS

| | | | |
|---|---|---|---|
| CN | 115307348 | | 1/1900 |
| CN | 203489560 | | 3/2014 |
| CN | 108759210 | B | 6/2021 |
| DE | 102011100198 | A1 | 8/2018 |
| JP | WO2017013757 | | 1/1900 |
| JP | 4812606 | B2 | 11/2011 |

* cited by examiner

HEATER SYSTEMS

BACKGROUND

Engine heaters maintain a temperature of a reciprocating engine. For example, heaters exist which are used with equipment, vehicles (e.g., locomotives, trucks, automobiles, ships, etc.), generators, etc. in order to maintain the reciprocating engines within a desired temperature range.

In some applications, heat pumps may be employed in order to maintain the reciprocating engines within a desired temperature range. However, the heat pumps use a refrigerant circulating inside of an evaporator heat exchanger ("evaporator") that utilizes outdoor ambient air as a heat source, but the temperature of the refrigerant may fall below freezing (0° C.) causing a temperature of surfaces (e.g., coil, fins, and/or tubes) of the evaporator to fall below a dew point temperature of the outdoor ambient air, which causes the outdoor ambient air to chill to below the dew point, causing frost to form on surfaces of the evaporator. If frost is allowed to form on the evaporator it will continue to accumulate, eventually blocking airflow and preventing efficient heat transfer to the point that failure of the heat pump occurs. The temperature at which frost begins to form on the evaporator defines the lowest ambient air temperature at which the heat pump can operate. In many locations, fall and wintertime outdoor air temperatures are at or below this "frosting" limit, which in the most efficient heat pump designs will be limited to approximately 4° C. This "frosting" limit may prevent operation of the heat pumps and may require use of relatively less efficient and more expensive means of heating to maintain the reciprocating engines within a desired temperature range during periods of low ambient air temperatures.

Thus, there remains a need to develop new heater systems that operate during periods of low ambient air temperatures to maintain reciprocating engines within a desired temperature.

SUMMARY

This summary is provided to introduce simplified concepts for systems, devices, and components of the disclosure which are further described below in the Detailed Description. This summary is not intended to identify essential features of the claimed subject matter, nor is it intended for use in determining the scope of the claimed subject matter.

In an embodiment, a heater system may provide for heating a reciprocating engine of equipment. For example, the heater system may provide for heating a reciprocating engine of a vehicle (e.g., a locomotive, a ship, or a truck, etc.), a reciprocating engine of a generator (e.g., an emergency standby generator), etc. The reciprocating engine may be a diesel engine, natural gas engine, natural gas and hydrogen blend engine, hydrogen engine, gasoline engine, petrol engine, etc. The heater system may utilize heat contained in the equipment to defrost the heater system during periods of low ambient air temperatures (e.g., about −10° F. (−23° C.)) to maintain the reciprocating engine of the equipment within a desired temperature range. The heater system maintains the temperature of equipment, such as an engine, in readiness for use while the equipment is otherwise nonoperational (e.g., in "standby" mode). A reversing valve may be fluidly coupled to an evaporator, a condenser, and a compressor, and the reversing valve may be caused to reverse a flow of a refrigerant to defrost (e.g., melt and/or remove frost) the heater system using the heat contained in the equipment.

In an embodiment, a heater system may include a refrigerant liquid line coupled between the condenser and the evaporator. The refrigerant liquid line may have an internal volume associated with an internal volume of the evaporator to minimize flooding the condenser while reversing the flow of the refrigerant to defrost the heater system.

In an embodiment, an electric resistance heater may be coupled between a coolant outlet of the condenser and the equipment. The electric resistance heater may be configured to heat a coolant circulating between the condenser and the equipment to maintain the reciprocating engine of the equipment within the desired temperature range.

In an embodiment, the evaporator may include a plurality of fins having a fin density of about 10 fins per inch to minimize causing the reversing valve to reverse the flow of the refrigerant, and therefore increase an amount of time between defrosts.

BRIEF DESCRIPTION OF THE DRAWINGS

The detailed description is described with reference to the accompanying figures. The use of the same reference numbers in different figures indicates similar or identical items.

DETAILED DESCRIPTION

Overview

Figure 1:
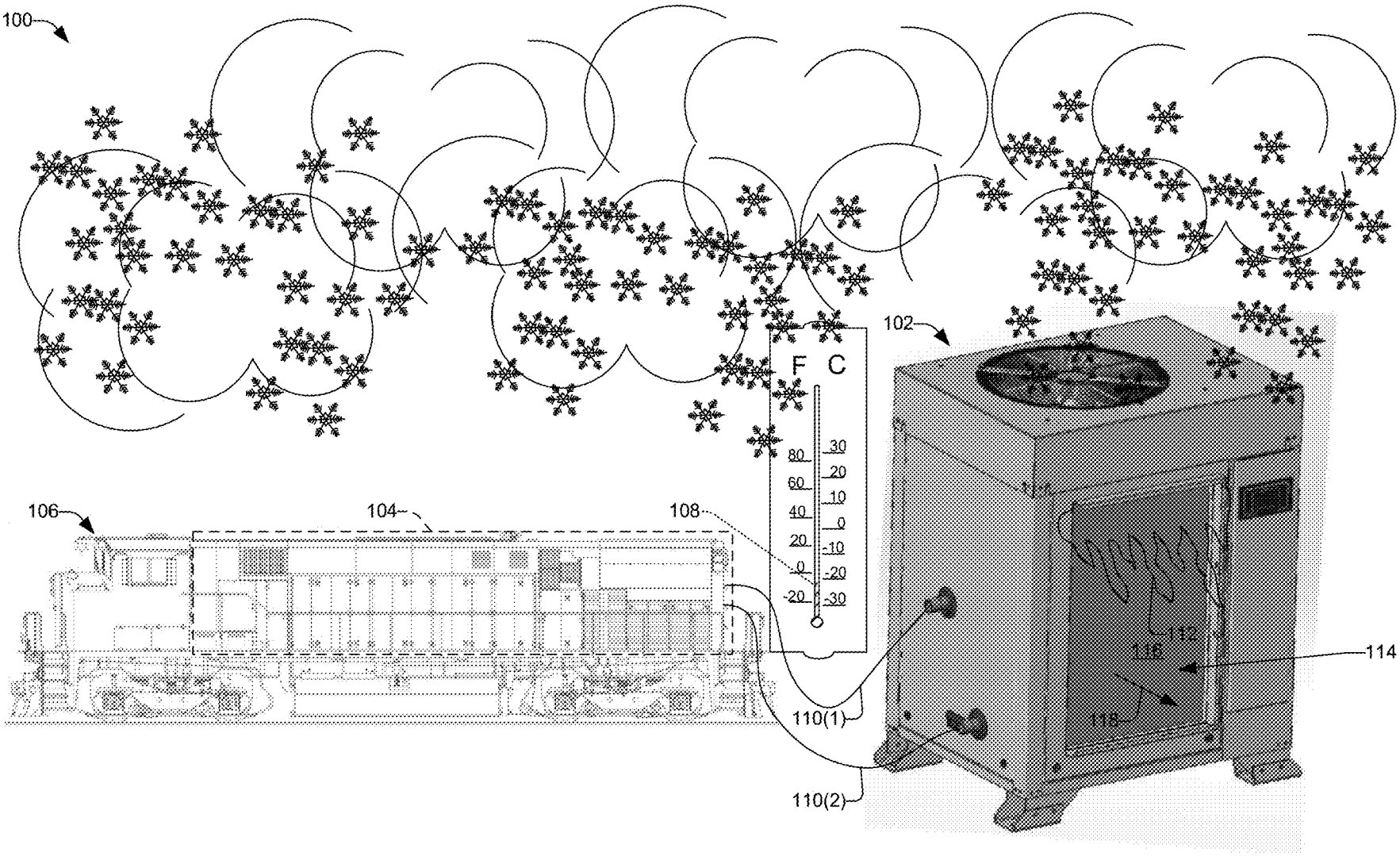
FIG. 1 illustrates an example environment involving a heater system heating a reciprocating engine of equipment during periods of low ambient air temperatures, according to an embodiment of the instant disclosure.

As noted above, liquid water can freeze on surfaces (e.g., coil, fins, and/or tubes) of the evaporator, eventually blocking airflow and preventing efficient heat transfer, if the temperature of a refrigerant circulating in an evaporator falls below freezing (0° C.) and the dew point is above freezing. This disclosure is directed to heater systems for heating a reciprocating engine of equipment, for example, that utilizes heat contained in equipment (e.g., locomotive, car, bus, ship, etc.) to defrost the evaporator during periods of low ambient air temperatures, and therefore are more efficient. In an embodiment of the instant application, the heater systems include a reversing valve fluidly coupled to an evaporator, a condenser, and a compressor. The reversing valve may be caused to reverse a flow of a refrigerant. The reversed flow of refrigerant may defrost (e.g., melting and/or removing frost) the evaporator during periods of low ambient air temperatures. The heater systems may utilize the heat contained in the equipment to heat the refrigerant and defrost the evaporator to maintain the reciprocating engine of the equipment within a desired temperature range during periods of low ambient air temperatures.

Comparatively, traditional heaters have been installed with equipment and arranged to maintain a diesel engine of the equipment within a desired temperature range via using outdoor ambient air as a heat source. For example, heat pumps utilizing an evaporator use outdoor ambient air as a heat source in order to maintain a diesel engine within a desired temperature range. However, because these traditional heaters utilize outdoor ambient air as a heat source, they are susceptible to frost accumulation during periods of low ambient air temperatures. The frost accumulation results in the traditional heat pumps being inefficient at maintaining the diesel engine of the equipment within a desired temperature range during these periods of low ambient air temperatures. Having reversing valves that reverse a flow of a refrigerant to defrost (e.g., melt and/or remove frost) an evaporator using heat contained in the equipment during periods of low ambient air temperatures may allow for optimizing an equipment's operation and reduce power consumption costs.

Accordingly, this disclosure describes heater systems that may result in a more efficient operation of the equipment. In an embodiment, a heater system may be fluidly coupled to a reservoir of the equipment, and the heater system may utilize the heat contained in the reservoir of the equipment to defrost the heater system to allow the heater system to continue to maintain the engine of the equipment within a desired temperature.

While this application describes implementations that are described in the context of heater system for maintaining a reciprocating engine of a vehicle within a desired temperature, the implementations described herein may be used in other environments and are applicable to other contexts. For example, the heater systems may be located at any desired location, including with a generator (e.g., backup generator) located at a server farm, a hospital, a high-rise building, remote cell tower site, an urban cell tower site, an oil site, a gas site, a residential site, a commercial retail site, etc.

In an embodiment, the heater systems may include a condenser fluidly coupled to a reciprocating engine of equipment and a reversing valve fluidly coupled to the condenser, an evaporator, and a compressor. For example, a condenser of the heater system may be fluidly coupled to a reservoir of a reciprocating engine, and the reversing valve may be fluidly coupled to the condenser, the evaporator, and the compressor to reverse a flow of a refrigerant circulating through the condenser, the evaporator, and the compressor. The reversed flow of refrigerant circulating through the condenser, the evaporator, and the compressor may defrost the evaporator using heat contained in the reciprocating engine during periods of low ambient air temperatures (e.g., under a certain threshold).

Example Heater Systems

FIG. 1 illustrates an example environment 100 involving a heater system 102 heating a reciprocating engine 104 of equipment 106 during periods of low ambient air temperatures 108, according to an embodiment of the instant disclosure. For example, FIG. 1 illustrates an environment 100 involving the heater system 102 fluidly connected, via coolant lines 110(1) and 110(2), with the reciprocating engine 104 of the equipment 106 to maintain the reciprocating engine 104 within a desired temperature range during a period of time when the ambient air temperature 108 is below freezing (0° C.).

Further, while maintaining the reciprocating engine 104 within the desired temperature range during the period of time when the ambient air temperature 108 is below freezing (or other threshold), frost 112 may accumulate on an evaporator 114 of the heater system 102. For example, because the outdoor air temperature 108 is below freezing (0° C.), frost 112 may accumulate on surfaces 116 (e.g., coil, fins, and/or tubes) of the evaporator 114, eventually blocking airflow 118 and preventing efficient heat transfer. To alleviate these concerns, the heater system 102 may utilize heat contained in the reciprocating engine 104 to defrost the evaporator 114 (e.g., melt the frost 112 accumulated on the surfaces 116 of the evaporator 114). In doing so, the heater system 102 is able to utilize the outdoor ambient air as a heat source in order to maintain the reciprocating engine 104 within the desired temperature range during the period of time when a refrigerant circulating in the evaporator 114 falls below freezing (0° C.) causing the outdoor ambient air to chill to below a dew point. Thus, the heater system 102 performs a defrost cycle, cycling between a first mode of heating the reciprocating engine 104 via using the outdoor ambient air as a heat source, and a second mode of defrosting the evaporator 114 via using the heat contained in the reciprocating engine 104. The heater system 102 may cycle between the first mode of heating the reciprocating engine 104 and the second mode of defrosting the evaporator 114 based at least in part on a heating capacity of heater system 102. In an embodiment, the heater system 102 may cycle between the first mode of heating the reciprocating engine 104 and the second mode of defrosting the evaporator 114 based at least in part on a coolant delta-T associated with a condenser of the heater system 102. In an embodiment, a desired temperature range may range from about 80° F. to about 100° F., which may be an optimal starting temperature of the reciprocating engine 104.

While FIG. 1 illustrates the equipment 106 comprises a locomotive (e.g., a diesel electric locomotive), the equipment 106 may be a ship, a truck, a car, etc. Moreover, while FIG. 1 illustrates the equipment 106 comprises a vehicle, the equipment 106 may be a generator (e.g., backup generator) located at a server farm, a hospital, a high-rise building, remote cell tower site, an urban cell tower site, an oil site, a gas site, a residential site, a commercial retail site, etc. Further, while FIG. 1 illustrates the heater system 102 disposed separate from the equipment 106, the heater system 102 may be disposed onboard the equipment 106. For example, the heater system 102 may be arranged on the equipment 106 for heating the reciprocating engine 104 of the equipment 106. In an embodiment, the heater system 102 is located onboard a locomotive at any position.

Figure 2:
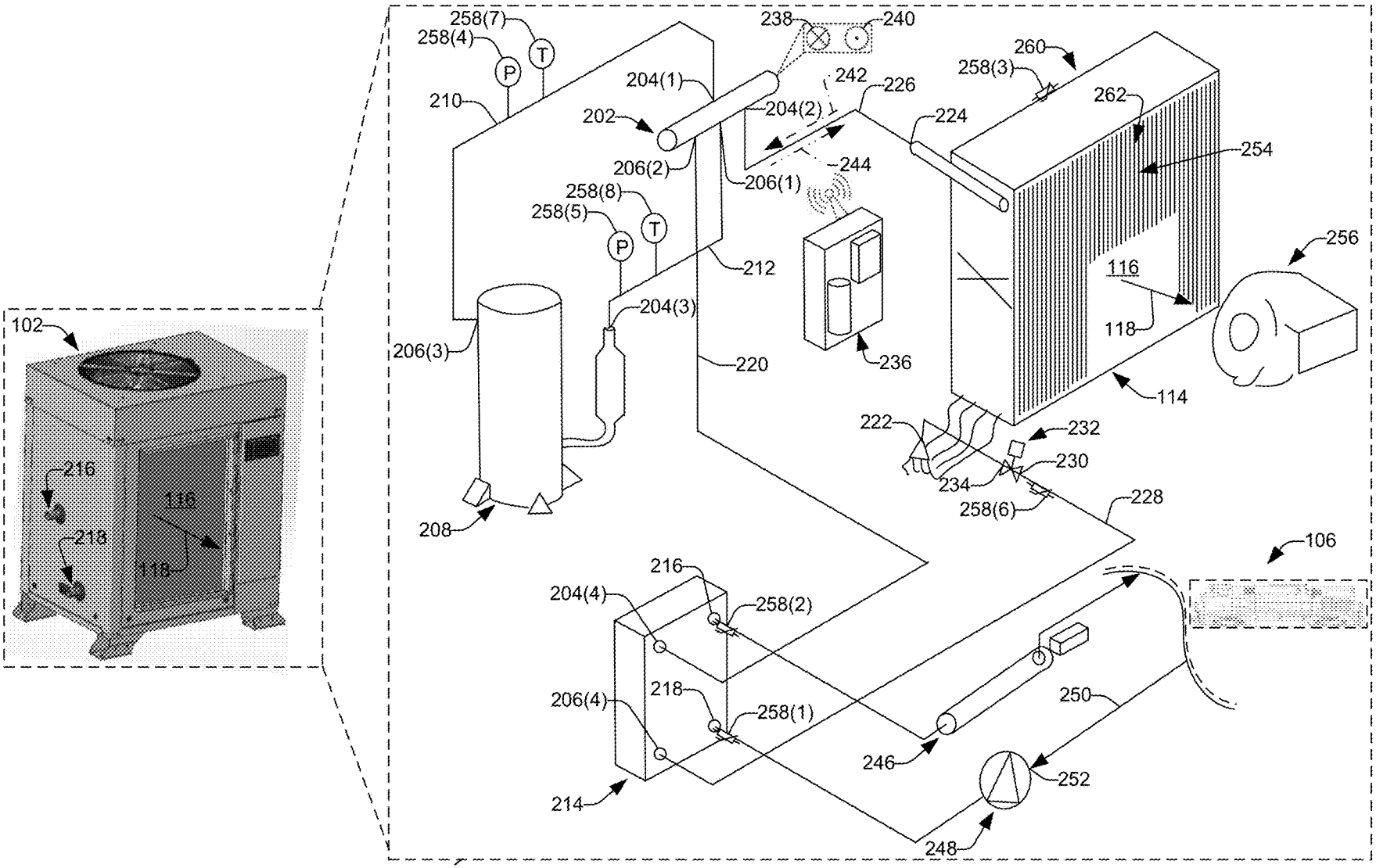
FIG. 2 illustrates a schematic diagram of the heater system of FIG. 1, according to an embodiment of the instant disclosure.

FIG. 2 illustrates a schematic diagram 200 of the heater system 102 of FIG. 1, according to an embodiment of the instant disclosure. The heater system 102 may include a reversing valve 202. The reversing valve 202 may include a first refrigerant inlet 204(1), a first refrigerant outlet 206(1), a second refrigerant inlet 204(2), and a second refrigerant outlet 206(2). In some embodiments, the reversing valve 202 may be a 4-way reversing valve, the first refrigerant outlet 206(1) may be a common outlet connection of the 4-way reversing valve, and the second refrigerant outlet 206(2) may be a normal outlet connection of the 4-way reversing valve. In an embodiment, when in heating mode (e.g., first mode) refrigerant coming from a discharge of a compressor moves through the 4-way reversing valve to a condenser and refrigerant coming from an evaporator is directed to a suction of the compressor. In an embodiment, when in defrost mode (e.g., second mode) refrigerant coming from the discharge of the compressor moves through the 4-way reversing valve to the evaporator (now a condenser) and refrigerant coming from the condenser (now an evaporator) is directed to the suction of the compressor.

The heater system 102 may include a compressor 208. In an embodiment, the compressor 208 comprises a variable speed refrigerant compressor. The compressor 208 may include a third refrigerant outlet 206(3) coupled to the first refrigerant inlet 204(1), and a third refrigerant inlet 204(3) coupled to the first refrigerant outlet 206(1). In some embodiments, a discharge line 210 may fluidly couple the third refrigerant outlet 206(3) to the first refrigerant inlet 204(1), and a compressor suction line 212 may fluidly couple the first refrigerant outlet 206(1) to the third refrigerant inlet 204(3).

The heater system 102 may include a condenser 214. The condenser 214 may include a fourth refrigerant inlet 204(4) coupled to the second refrigerant outlet 206(2), a fourth refrigerant outlet 206(4), a coolant outlet 216 coupled to the piece of equipment 106, and a coolant inlet 218 coupled to the piece of equipment 106. In some embodiments, a discharge line 220 may fluidly couple the fourth refrigerant inlet 204(4) to the second refrigerant outlet 206(2). In some embodiments, the coolant outlet 216 may be fluidly coupled to the piece of equipment 106 via the coolant line 110(1), and the coolant inlet 218 may be fluidly coupled to the piece of equipment 106 via the coolant line 110(2).

As discussed above with regard to FIG. 1, the heater system 102 includes the evaporator 114. The evaporator 114 may include an inlet 222 coupled to the fourth refrigerant outlet 206(4), and an outlet 224 coupled to the second refrigerant inlet 204(2). In some embodiments, the outlet 224 of the evaporator 114 may comprise a suction connection. In some embodiments, an evaporator line 226 may fluidly couple the outlet 224 to the second refrigerant inlet 204(2). In some embodiments, a refrigerant liquid line 228 may fluidly couple the fourth refrigerant outlet 206(4) to the inlet 222. For example, the refrigerant liquid line 228 may be coupled between the fourth refrigerant outlet 206(4) and the inlet 222. An expansion valve (discussed in detail below) is arranged between the fourth refrigerant outlet 206(4) to the inlet 222. In some embodiments, the refrigerant liquid line 228 has an internal volume associated with an internal volume of the evaporator 114, such that the sum of the condenser 214 internal volume plus the internal volume of the refrigerant liquid line 228 are about equal to the internal volume of the evaporator 114. In some embodiments, the refrigerant liquid line 228 has an internal volume of at least about 200 $cm^3$ (12.2 $in^3$) to at most about 220 $cm^3$ (13.6 $in^3$). In some embodiments, the condenser 214 has an internal volume of about 560 $cm^3$ (34 $in^3$). Since condenser 214 and the refrigerant liquid line 228 contains primarily liquid, and the evaporator 114 contains gas with some liquid (two-phase), the mass of refrigerant contained in the condenser 214 and the refrigerant liquid line 228 is equivalent to the mass contained in the evaporator 114.

This matching of internal volumes minimizes the possibility of flooding the condenser 214 and/or cause excessive compressor discharge pressures during the defrost cycle. For example, in a heating mode (e.g., first mode), the condenser 214 is mostly filled with both liquid and gas, but the refrigerant liquid line 228 needs to be all liquid with no gas. Similarly, in the evaporator 114, the inlet 222 has gas and liquid, but by the time the refrigerant makes it all the way through the evaporator 114, the refrigerant is a pure vapor in evaporator line 226. In defrost mode (e.g., second mode), the roles are reversed, so the refrigerant liquid line 228 is filled with 2-phase refrigerant and discharge line 220 is pure vapor. The volumes are not completely identical between refrigerant liquid line 228 plus the condenser 214 and the evaporator 114, but the refrigerant liquid line 228 is larger to accommodate normal operation and a short amount of defrost time.

In some embodiments, the refrigerant liquid line 228 may be further fluidly connected to an inlet 230 of an expansion valve 232, where an outlet 234 of the expansion valve 232 is fluidly connected to the inlet 222 of the evaporator 114. The refrigerant liquid line 228 connects the fourth refrigerant outlet 206(4) to the valve 232. The refrigerant liquid line 228 may cease at the valve 232. In a second mode (e.g., defrost mode) the refrigerant liquid line 228 may not be a liquid line. The refrigerant liquid line 228 couples the fourth refrigerant outlet 206(4) to the valve 232 at the inlet 230 and the outlet 234 connects to the evaporator inlet 222.

In an embodiment, the expansion valve 232 comprises an electronic expansion valve. The expansion valve 232 being capable of controlling a flow of the refrigerant into and/or out of the evaporator 114. While FIG. 2 illustrates the expansion valve 232 may be an electronic expansion valve, the expansion valve may be a different type of valve. For example, the expansion valve may be a temperature expansion valve and capillary tubes for taking high-pressure liquid on one side and releasing a lower pressure 2-phase stream. The expansion valve 232 may throttle the liquid refrigerant from high pressure liquid to low pressure 2-phase refrigerant. The compressor 208 creates the high pressure, the condenser 214 makes the gas a liquid, the expansion valve 232 throttles the pressure down, and the evaporator 114 removes any liquid left in the stream. In an embodiment, the engine coolant comprises a 50/50 mix of ethylene glycol and water. For example, the heater system 102 may be optimized to heat a 50/50 mix of ethylene glycol and water to the desired temperature range of about 100° F., which is a relatively lower temperature than a traditional air-source water heater that typically heats 100% water to at least about 140° F.

The heater system 102 includes a controller 236 that controls components of the heater system 102. The controller 236 may control the components of the heater system 102 to reduce an amount of electricity used to maintain the reciprocating engine 104 within the desired temperature range at all times, including during the period of time when the ambient air temperature 108 is below freezing. The controller 236 may comprise a programmable electronic controller (e.g., a c.pco mini Combo drive controller available from CAREL). In an embodiment, the controller 236 causes the reversing valve 202 to operate between a first mode 238 (e.g., heating mode) and a second mode 240 (defrosting mode). In an embodiment, the controller 236 may receive data representing a coolant delta-T associated with the condenser 214 of the heater system 102 that may cause the reversing valve 202 to operate between the first mode 238 and the second mode 240. When operating in the first mode 238, the heater system 102 utilizes a refrigerant (e.g., R32), circulating in a first direction 242 and heated via the evaporator 114, to maintain the piece of equipment within a desired temperature range. When operating in the second mode 240, the heater system 102 utilizes the refrigerant, circulating in a second direction 244 opposite the first direction 242 and heated via the piece of equipment 106, to defrost the evaporator 114. In an embodiment, the second mode 240 may comprise a reverse cycle hot gas defrosting mode. For example, operating in the second mode 240 causes the refrigerant to condense in the evaporator 114 and evaporate in the condenser 214. In an embodiment, when operating in the second mode 240, the source of heat becomes residual heat contained in a coolant reservoir of the reciprocating engine 104. Because a volume of the coolant reservoir is relatively large (e.g., between 30 gallons and 60 gallons) and the temperature of the coolant reservoir is relatively high (e.g., between 80° F. and 120° F.), the defrosting of the evaporator 114 proceeds very quickly and efficiently, minimizing a time required for defrosting the evaporator 114 and minimizing an amount of heat removed from the coolant reservoir. For example, using the coolant of the reciprocating engine 104, which is at a relatively high temperature, as the heat source for the heater system 102 during defrosting makes the defrost efficiency high and therefore the duration of the defrost short—on the order of 3 to 5 minutes.

In an embodiment, the controller 236 causes the reversing valve 202 to operate between the first mode 238 and the second mode 240 based at least in part on a heating capacity of the evaporator 114. The second mode 240 may be initiated when the controller 236 determines defrosting is needed as determined by an allowable drop in heating capacity of the evaporator 114. For example, as frost 112 accumulates on the surfaces 116 of the evaporator 114, a heating capacity associated with the evaporator 114 is reduced over time. When a measured temperature rise of the refrigerant through the condenser 214 falls to approximately 60-80% of the temperature rise immediately following a defrost, a new defrost cycle may be initiated. Initiating defrosts is accomplished on a "demand" basis rather than a more conventional timed basis. This defrost cycling allows continued energy efficient operation of the heater system 102 during periods of below frosting ambient temperatures, maximizes the time-averaged heating capacity of the heater system 102, and maximizes energy efficiency of the heater system 102 heating the reciprocating engine 104.

FIG. 2 illustrates the heater system 102 may further comprise an electric resistance heater 246. In an embodiment, the resistance heater 246 may be coupled between the coolant outlet 216 and the piece of equipment 106. The electric resistance heater 246 may be configured to heat the coolant circulating between the condenser 214 and the piece of equipment 106 to maintain the piece of equipment 106 within the desired temperature range while the heater system 102 is in the second mode 240. For example, the electric resistance heater 246 may be an auxiliary electric resistance heater configured to reheat the coolant during the second mode 240, to maintain a constant temperature of the coolant reservoir of the reciprocating engine 104 throughout the entire period of low ambient temperature operation including during defrosting. The heat that is taken from the coolant by the heater system 102 during defrosting can be made up by the resistance heater 246 which can be controlled to reheat the coolant by an amount needed by the heater system 102 for defrosting. While FIG. 2 illustrates the resistance heater 246 being incorporated into the heater system 102, the resistance heater 246 may be incorporated into the piece of equipment 106.

FIG. 2 illustrates the heater system 102 includes a pump 248. In an embodiment, coolant from the equipment 106 is piped 250 to a pump inlet 252 of the pump 248. The coolant is pumped through the pump 250 to the coolant inlet 218 of the condenser 214. The coolant that is heated in the condenser 214, leaves the coolant outlet 216, and is returned to the equipment 106 to maintain the reciprocating engine 104 within the desired temperature range. In an embodiment, the coolant may comprise an engine coolant of the reciprocating engine 104. In another embodiment, the coolant may comprise an engine oil of the reciprocating engine 104. While FIG. 2 illustrates the condenser 214 heating a coolant, the condenser 214 may heat a hydraulic oil, a fuel (e.g., diesel fuel), etc.

FIG. 2 illustrates the evaporator 114 comprises a plurality of fins 254. In an embodiment, the plurality of fins 254 may have a fin density of 10 fins per inch (e.g., 2.5 mm space between fins). This fin density of 10 fins per inch may minimize the controller 236 causing the reversing valve 202 to operate in the second mode 240 to defrost the evaporator 114, and thus increasing a runtime of the heater system 102 heating the reciprocating engine 104 between defrosts. For example, the fin density of 10 fins per inch may allow the heater system 102 to operate approximately 50% longer between defrosts as compared to heat pumps that are designed with evaporators having fin spacing which is closer, commonly 14 to 20 fins per inch (1.3 mm to 1.8 mm space between fins). By allowing continued operation of the heater system 102 during periods of low ambient temperatures, the cost to maintain minimum standby temperatures in equipment and engines is reduced during winter months by as much as ½ to ⅓ compared to electric resistance heating. Moreover, traditional heat pump designs require a separate auxiliary heater to provide heating of the equipment or engine coolant during periods of low ambient air temperatures (winter months). The heater system 102 eliminates the need for and cost of an auxiliary heater since the heater system 102 can be operated throughout the year.

The heater system 102 includes a fan 256. The fan 256 may be disposed with the evaporator 114. The fan 256 may displacing the ambient air through the evaporator 114. For example, the fan 256 may provide the airflow 118 through the plurality of fins 254 of the evaporator 114.

FIG. 2 illustrates the heater system 102 comprises a first sensor 258(1) disposed on the coolant inlet 218 and a second sensor 258(2) disposed on the coolant outlet 216. In an embodiment, the first and second sensors 258(1) and 258(2) are temperature sensors. For example, the first and second sensors 258(1) and 258(2) may be Negative Temperature Coefficient (NTC) temperature sensors. The first sensor 258(1) may measure a temperature of the coolant entering the coolant inlet 218, while the second sensor 258(2) may measure a temperature of the coolant exiting the coolant outlet 216. The first sensor 258(1) and second sensor 258(2) may be configured to monitor a change in temperature of the coolant circulating through the condenser 214. In an embodiment, the controller 236 may cause the reversing valve 202 to operate in the second mode 240 based at least in part on the change in temperature of the coolant. For example, in code stored on the controller 236, the temperature from the coolant inlet 218 of the condenser 214 is subtracted from the temperature of the coolant outlet 216 of the condenser 214. The code on the controller 236 may calculate the change in temperature every Programmable Logic Controller (PLC) cycle (e.g., calculated roughly every 30 ms). This change in temperature is stored in memory of the controller 236 as a coolant delta-T. In an embodiment, in the code on the controller 236, there is a block (e.g., a PLC programming "permissive"; here in this case, an "and" block that requires all inputs to be true for the output to be true) that takes these temperatures and samples them every couple of minutes and then creates a rolling average of them over the last 3 samples. The code on the controller 236 then compares the current rolling average to the past rolling average and returns the difference.

FIG. 2 illustrates, the heater system 102 comprises a third sensor 258(3) disposed on an air inlet side 260 opposite an air outlet side 262 of the evaporator 114. In an embodiment, the third sensor 258(3) is a temperature sensor. For example, the third sensor 258(3) may be an NTC temperature sensor. The third sensor 258(3) may measure a temperature of the ambient air entering the air inlet side 260 of the evaporator 114.

FIG. 2 illustrates that the heater system 102 may comprises a fourth sensor 258(4) disposed with the discharge line 210 and a fifth sensor 258(5) disposed with the compressor suction line 212. In an embodiment, the fourth and fifth sensors 258(4) and 258(5) are pressure sensors. For example, the fourth and fifth sensors 258(4) and 258(5) may be pressure transducers. The fourth sensor 258(4) may measure a discharge pressure from the compressor 208. The fifth sensor 258(5) may measure a suction pressure of the compressor 208. In an embodiment, the controller 236 may use the sensor values reported from the fifth sensor 258(5) to calculate an evaporation temperature of the refrigerant circulating through the evaporator 114. In an embodiment, the controller 236 may combine the sensor values reported from the fifth sensor 258(5) and the eight sensor 258(8) to determine a superheat temperature (temperature above the liquid temperature at the given pressure) at the compressor inlet. In an embodiment, the controller 236 may use thermodynamic tables for the refrigerant circulating through the evaporator 114 to calculate an actual evaporation temperature. These measurements may be taken every PLC cycle.

The heater system 102 may comprise a sixth sensor 258(6) disposed with the inlet 230 of the expansion valve 232. In an embodiment, the sixth sensor 258(6) is a temperature sensor. For example, the sixth sensor 258(6) may be a Negative Temperature Coefficient (NTC) temperature sensor. The sixth sensor 258(6) may measure a temperature of the liquid refrigerant contained in the refrigerant liquid line 228.

The heater system 102 may comprise a seventh sensor 258(7) disposed with the discharge line 210 and an eighth sensor 258(8) disposed with the compressor suction line 212. In an embodiment, the seventh and eighth sensors 258(7) and 258(8) are temperature sensors. For example, the seventh and eighth sensors 258(7) and 258(8) may be NTC temperature sensors. The seventh sensor 258(7) may measure a temperature of the refrigerant being discharged from the compressor 208, while the eighth sensor 258(8) may measure a temperature of the refrigerant entering the compressor 208. In an embodiment, the controller 236 may use the sensor values reported from the fourth sensor 258(4) to calculate a condensing temperature of the refrigerant circulating through the condenser 214. In an embodiment, the controller 236 may combine the sensor values reported from the seventh sensor 258(7) and the fourth sensor 258(4) to determine a superheat temperature (temperature above the saturation temperature (i.e., the temperature where the phase change occurs) at the given pressure) at the compressor outlet. In an embodiment, the controller 236 may combine the sensor values reported from the eight sensor 258(8) and the fifth sensor 258(5) to determine a superheat at the compressor suction. In an embodiment, the controller 236 may combine the seventh sensor 258(7) and the fourth sensor 258(4) to determine the discharge superheat.

Example Process of Heating Equipment

Figure 3A:
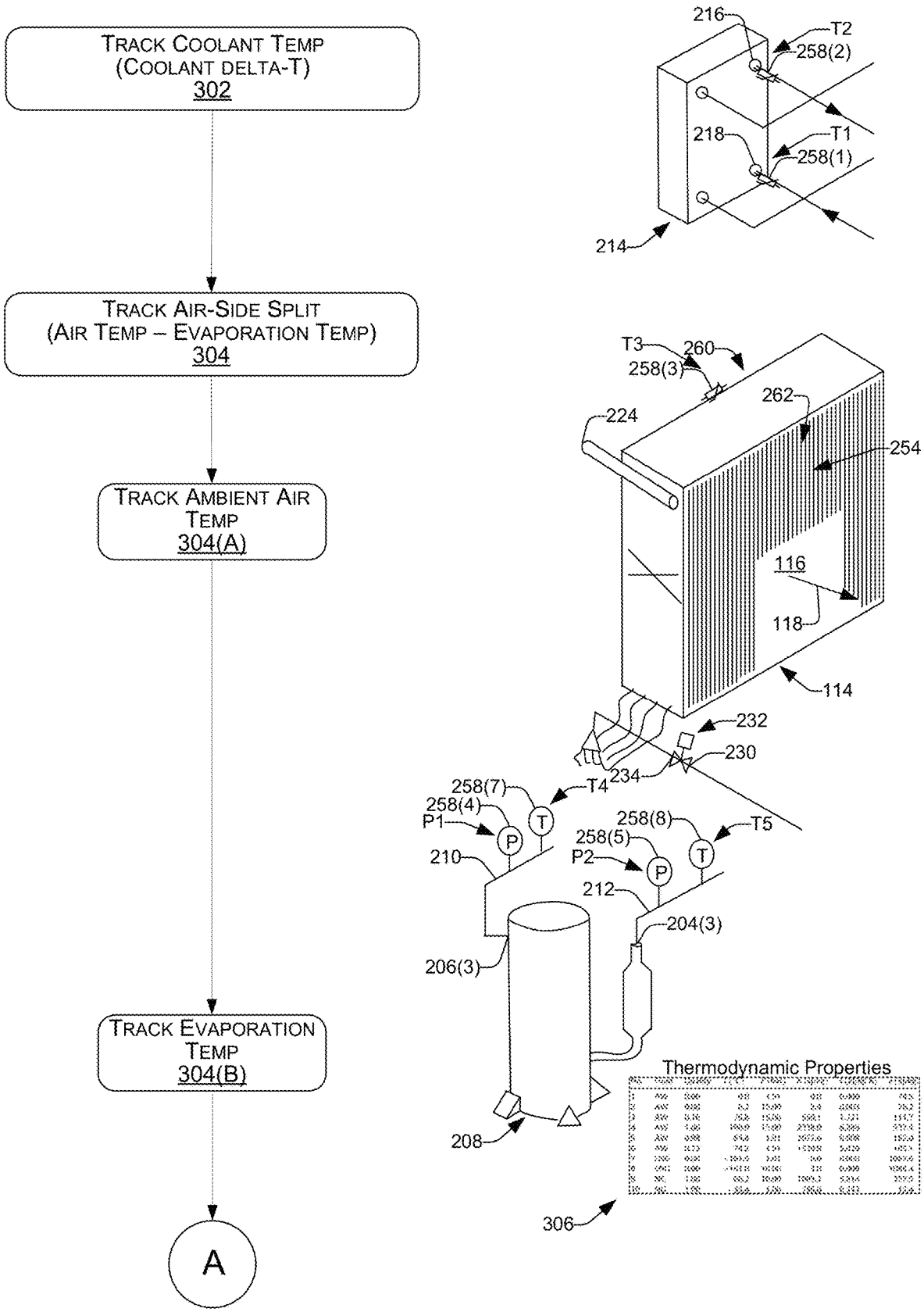
FIGS. 3A, 3B, and 3C are a flow diagram that illustrates an example process of heating equipment disposed in the environment of FIG. 1 during periods of low ambient air temperatures, according to an embodiment of the instant disclosure.
Figure 3B:
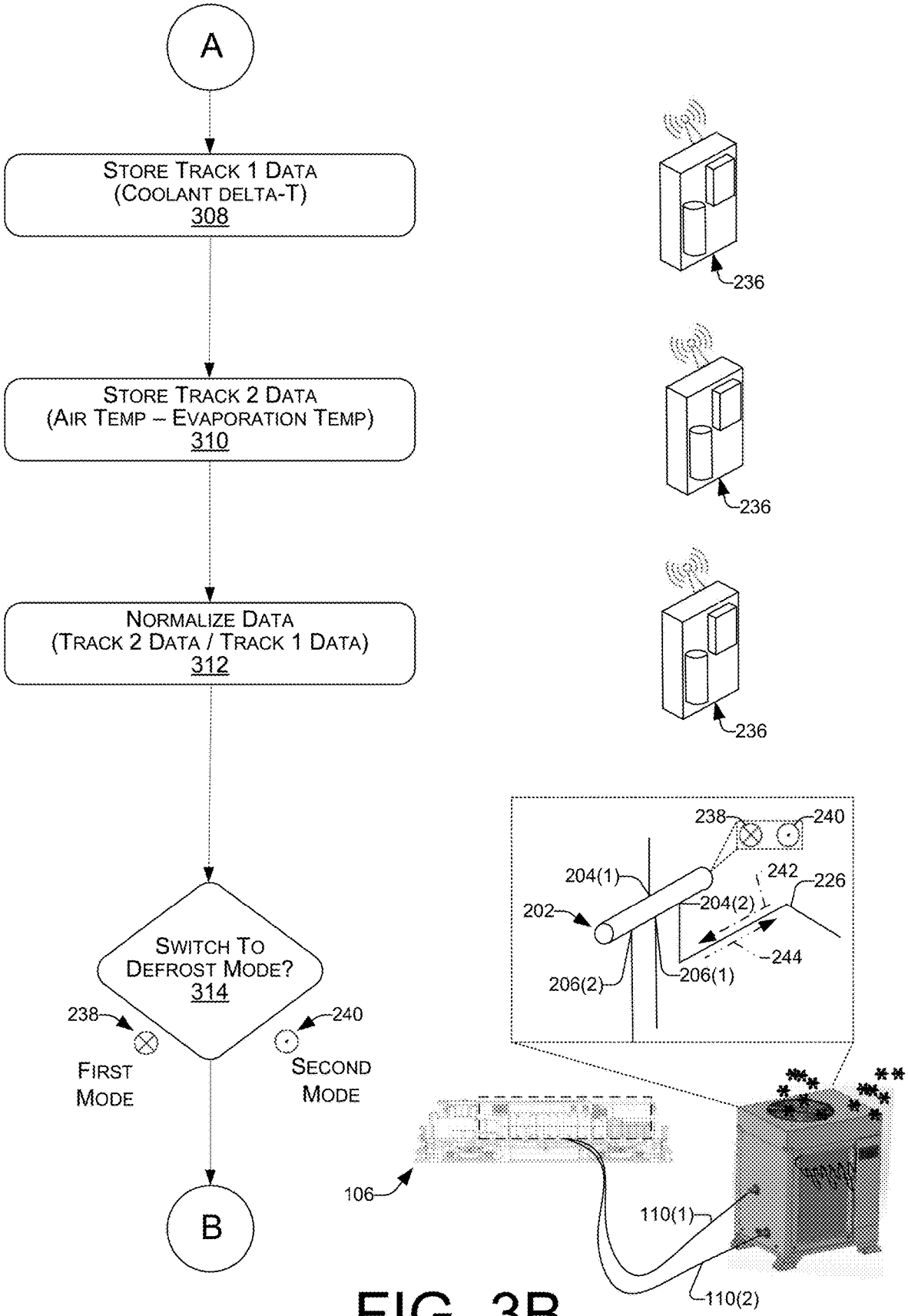
Figure 3C:
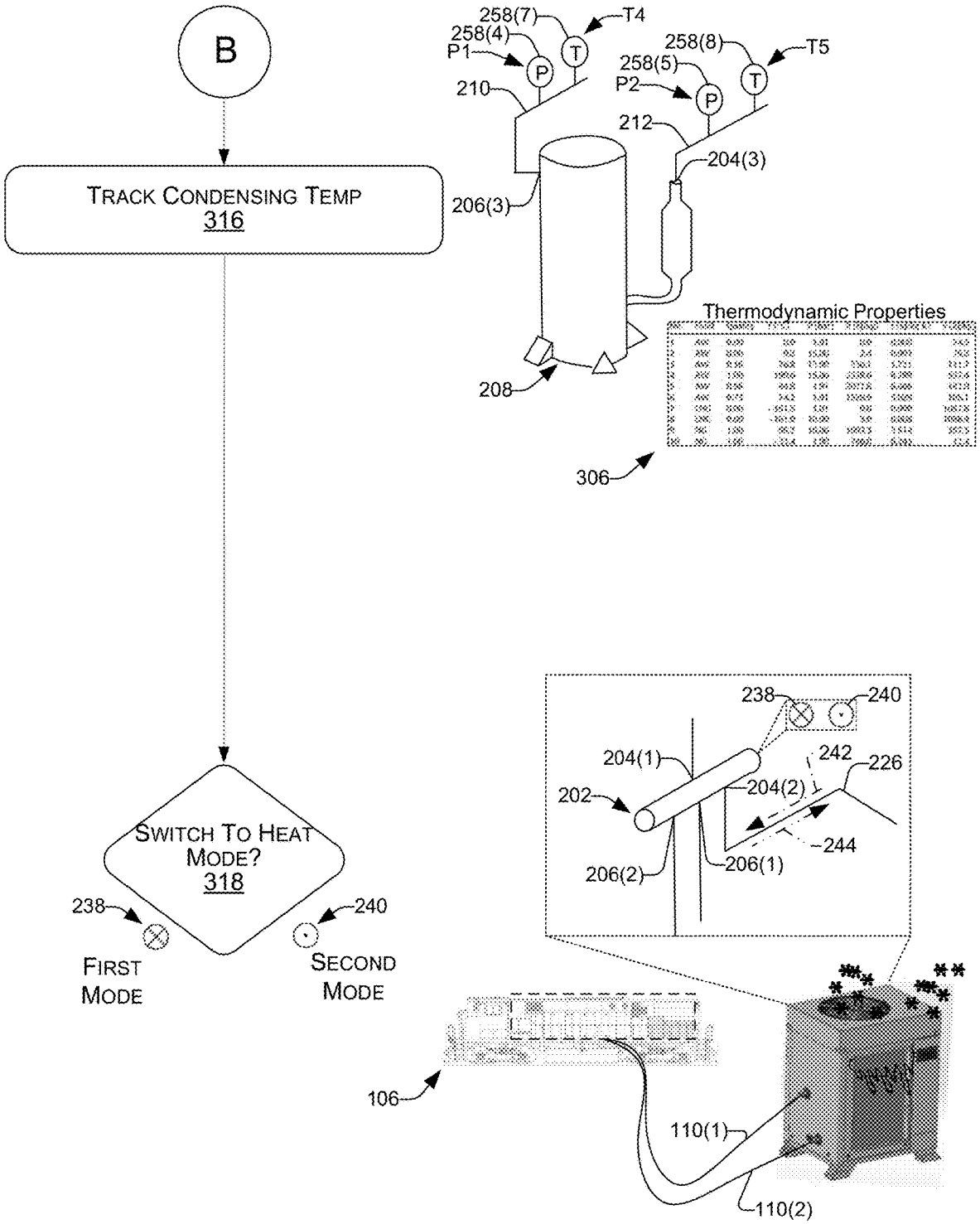

FIGS. 3A, 3B, and 3C are a flow diagram that illustrates an example process 300 of heating equipment (e.g., equipment 106) disposed in an environment (e.g., environment 100) during periods of low ambient air temperatures (e.g., low ambient air temperatures 108) according to an embodiment of the instant disclosure.

The operations of the example process are illustrated in individual blocks and summarized with reference to those blocks. The process is illustrated as a logical flow of blocks, each block of which can represent one or more operations that can be implemented in hardware, software, or a combination thereof. In the context of software, the operations represent computer-executable instructions stored on one or more non-transitory computer-readable storage media that, when executed by one or more processors, enable the one or more processors to perform the recited operations. Generally, computer-executable instructions include routines, programs, objects, modules, components, data structures, and the like that perform particular functions or implement particular abstract data types. Note that the order in which the processes are described is not intended to be construed as a limitation, and any number of the described operations can be executed in any order, combined in any order, subdivided into multiple sub-operations, and/or executed in parallel to implement the described process. Additionally, individual blocks may be deleted from the processes without departing from the spirit and scope of the subject matter described herein.

The process 300 begins at operation 302, which represents a controller (e.g., controller 236), associated with a heater system (e.g., heater system 102), tracking data representing a temperature associated with a condenser (e.g., condenser 214). For example, the controller may receive data representing a first temperature (T1) of a coolant entering a coolant inlet (e.g., coolant inlet 218) of the condenser measured by a sensor (e.g., first sensor 258(1)) and/or data representing a second temperature (T2) of the coolant exiting a coolant outlet (e.g., coolant outlet 216) measured by a sensor (e.g., second sensor 258(2)). In some embodiments, operation 302 includes determining a coolant delta-T, where the coolant delta-T includes subtracting T1 from T2. For example, the temperature from the coolant inlet of the condenser is subtracted from the temperature from the coolant outlet. In an embodiment, the temperature from the coolant inlet of the condenser may be subtracted from the temperature from the coolant outlet every PLC cycle (e.g., 30 ms). The temperature from the coolant inlet of the condenser subtracted from the temperature from the coolant outlet defining the coolant delta-T. In some embodiments, operation 302 includes determining a current rolling average coolant delta-T. The current rolling average delta-T being equal to a sample of the coolant delta-T taken every couple of minutes (e.g., 2 minutes) and averaged over a quantity of about three (3) samples of the coolant delta-T. In some embodiments, operation 302 includes comparing the current rolling average coolant delta-T to a previous rolling average coolant delta-T, and returning a difference between the current rolling average coolant delta-T and the past rolling average coolant delta-T. In an embodiment, the difference between the current rolling average coolant delta-T and the past rolling average coolant delta-T may define the coolant delta-T.

Process 300 includes operation 304, which represents the controller tracking data representing an air-side split associated with an evaporator (e.g., evaporator 114). In an embodiment, operation 304 includes operation 304(A) and/or operation 304(B).

Operation 304(A) represents the controller tracking data representing an air temperature associated with the evaporator. For example, operation 304(A) may represent the controller tracking data representing a third temperature (T3) of ambient air entering an inlet side (e.g., air inlet side 260) of the evaporator measured by a sensor (third sensor 258(3)). The temperature of the ambient air entering the inlet side of the evaporator defining the air temperature.

Operation 304(B) represents the controller tracking data representing an evaporation temperature associated with the evaporator. For example, operation 304(B) may represent the controller tracking data representing a first pressure (P1)

of a discharge pressure of a compressor (compressor 208) measured by a sensor (fourth sensor 258(4)) and/or a second pressure (P2) of a suction pressure of the compressor measured by a sensor (fifth sensor 258(5)). In an embodiment, operation 304(B) may further represent the controller using the data representing the first pressure (P1) value and/or the second pressure (P2) value to calculate an evaporation temperature of the refrigerant circulating through the evaporator. For example, the controller may use a thermodynamic table 306 for the refrigerant circulating through the evaporator to calculate an actual evaporation temperature. Operation 304(B) may further represent the controller tracking data representing a fourth temperature (T4) of the refrigerant being discharged from the compressor measured by a sensor (e.g., seventh sensor) and/or data representing a fifth temperature (T5) of the refrigerant entering the compressor measured by a sensor (e.g., eighth sensor). The controller may use data representing the fourth temperature (T4) and/or the fifth temperature (T5) along with the data representing the first pressure (P1) value and/or the second pressure (P2) value to calculate the evaporation temperature.

Process 300 includes operation 308, which represents the controller storing the data representing the coolant delta-T as track 1 data. For example, operation 308 may represent the controller storing the data representing the difference between the temperature of the coolant inlet of the condenser subtracted from the temperature of the coolant outlet as track 1 data.

Process 300 includes operation 310, which represents the controller storing the data representing the air-side split as track 2 data. For example, operation 310 may represent the controller subtracting the air temperature (determined at operation 304(A)) from the evaporation temperature (determined at operation 304(B)) and storing data representing this difference as the track 2 data.

Process 300 includes operation 312, which represents the controller normalizing the track 1 data and the track 2 data. For example, operation 312 may represent the controller dividing the track 2 data (air-side split data determined at operation 308) by the track 1 data (coolant delta data determined at operation 308). The track 2 data divided by the track 1 data defining a defrost parameter.

Process 300 includes operation 314, which represents the controller determining whether to cause the heater system to go into a second mode (e.g., second mode 240) to defrost the evaporator. For example, operation 314 may represent the controller determining whether to cause the reversing valve to switch from operating in a first mode (e.g., first mode 238) to the second mode to defrost the evaporator.

During the first mode (e.g., normal heating operation) the refrigerant which has been compressed to a high pressure and temperature state in the compressor 208 passes through the reversing valve (reversing valve 202) to the condenser (condenser 214) via a discharge line (discharge line 220). In the condenser the refrigerant is condensed from vapor to liquid states, in the process of heating the coolant which enters through a coolant inlet (coolant inlet 218) of the condenser and exits through a coolant outlet (coolant outlet 216) of the condenser at a higher temperature (e.g., between 80° F.-120° F.). The refrigerant that has been condensed in the condenser passes through a refrigerant liquid line (e.g., refrigerant liquid line 228) to an expansion valve (expansion valve 232) where it is throttled to an evaporating pressure and passes to the inlet (inlet 222) of the evaporator. The refrigerant evaporates from liquid to vapor state as it passes through the evaporator cooling an airflow (airflow 118) which is drawn across fins (plurality of fins 254) of the evaporator 114 by a fan (fan 256).

During periods of low ambient air temperatures, when the evaporating temperature of the refrigerant falls below freezing (0° C.), frost may form (depending on a dewpoint of the incoming air) and accumulate on the fins of the evaporator. As the frost accumulates it restricts the airflow and gradually reduces the overall heating capacity of the heater system. At operation 314, to restore the heating capacity of the heater system, the controller may determine to switch the reversing valve to the second mode to initiate a defrost cycle to heat the evaporator using the heat from the equipment and melt the frost.

At operation 314, the controller may determine to switch the reversing valve to the second mode to initiate the defrost cycle when (1) the evaporation temperature is below freezing, (2) the air-side split is trending upward, (3) the coolant delta-T is trending downward, (4) a speed of the compressor is relatively steady, and/or (5) the defrost parameter is above a certain threshold. In an embodiment, the controller may determine to switch the reversing valve to the second mode to initiate the defrost cycle when each of these five criteria are true. For example, for the heater system to go into the defrosts cycle, following five criteria must be true: (1) the evaporation temperature is below freezing, (2) the air-side split is trending upward, (3) the coolant delta-T is trending downward, (4) a speed of the compressor is relatively steady, and (5) the defrost parameter is above a certain threshold. In an embodiment, if the heater system is on and the evaporation temperature is below freezing for more than four (4) hours, there may be a lower threshold to meet to ensure that the heater system is running at peak performance.

When the controller determines to switch the reversing valve to the second mode, the defrost cycle may follow the following sequence:

(1) The compressor continues to run. Compressor may continue to run to a fixed speed to ensure proper pressure exists at the reversing valve;
(2) The reversing valve changes position to the second mode;
(3) The fan stops;
(4) Refrigerant discharge gas passes from a refrigerant inlet (first refrigerant inlet 204(1)) of the reversing valve to a refrigerant outlet (first refrigerant outlet 206(1)) of the reversing valve;
(5) Refrigerant discharge gas enters an outlet (outlet 224) of the evaporator;
(6) Refrigerant condenses in the evaporator heating the evaporator and melting the frost;
(7) Liquid refrigerant leaves the evaporator through an inlet (inlet 222) and passes through an expansion valve (expansion valve 232) where it is throttled to evaporating pressure and enters the condenser through a refrigerant outlet (fourth refrigerant outlet 206(4)) of the condenser;
(8) The refrigerant evaporates in the condenser and leaves as a vapor through a refrigerant inlet (refrigerant inlet 204(4)) of the condenser; and/or
(9) The refrigerant vapor passes through a discharge line (discharge line 220) into a refrigerant outlet (second refrigerant outlet 206(2)) of the reversing valve.

After termination of the defrost cycle the reversing valve is returned to its normal position and the fan is restarted. In an embodiment, the fan may be restarted a period of time (e.g., 30 seconds) after the reversing valve is returned to its normal position to avoid blowing "snow" on the backside of the coil. During the defrost cycle, the coolant flows in the same direction as during normal heating operation except that instead of being heated, the coolant is being cooled. For example, during the defrost cycle, the coolant flows from the coolant outlet (coolant outlet 216) to the coolant reservoir of the reciprocating engine and back to the coolant inlet (coolant inlet 218) of the condenser. As discussed above, an electric resistance heater (electric resistance heater 246) may be configured to reheat the coolant during the defrost cycle, to maintain a constant temperature of the coolant reservoir of the reciprocating engine during the defrost cycle. For example, the electric resistance heater may be an auxiliary electric resistance heater configured to make up the heat extracted from the coolant by the condenser during the defrost cycle. The amount of voltage applied to the electric resistance heater may be controlled by the controller to maintain a constant coolant temperature exiting the heater as measured by the first sensor 258(1). The addition of the electric resistance heater allows the temperature of the coolant in the equipment or engine to be maintained at all times, even during defrosting of the evaporator.

Process 300 includes operation 316, which represents the controller tracking a condensing temperature. For example, operation 316 may represent the controller tracking data representing the refrigerant temperature and/or the refrigerant pressure associated with the compressor. For example, the controller may receive data representing the fourth temperature (T4) of the refrigerant being discharged from the compressor and/or data representing the first pressure (P1) value of the refrigerant being discharged from the compressor. For example, the discharge pressure may be the key measurement to knowing the condensing temperature. During a phase change there is one temperature associated with one pressure, so the discharge pressure is almost identical to the pressure inside the condenser and a saturation temperature may be looked up on the thermodynamic table 306 to determine the saturation temperature. In an embodiment, operation 316 may further represent the controller using the data representing the fourth temperature (T4) and/or data representing the fifth temperature (T5) to calculate the condensing temperature of the refrigerant. For example, the controller may use the thermodynamic table 306 for the refrigerant circulating through the evaporator to calculate the condensing temperature of the refrigerant. Operation 316 may further represent the controller tracking the data representing the first pressure (P1) value and/or data representing the second pressure (P2) value along with the fourth temperature (T4) and/or the fifth temperature T5) to calculate the condensing temperature.

Process 300 includes operation 318, which represents the controller determining whether to cause the heater system to go into the first mode (e.g., first mode 238) to heat the equipment. For example, operation 318 may represent the controller determining whether to cause the reversing valve to switch from operating in the second mode to the first mode to heat the equipment. At operation 318, the controller may determine to switch the reversing valve to the first mode to initiate the heating of the equipment when the temperature and the pressure of the refrigerant rises quickly. For example, when the condensing temperature of the refrigerant during defrost suddenly rises by about 10° C. or more, the controller may determine to switch the reversing valve to the first mode to initiate the heating of the equipment. For example, the controller may determine the condensing temperature of the refrigerant during defrost may be about 50° C. while the frost is melting, and then the controller determines that the temperature of the refrigerant suddenly rises to about 60° C. or more. As a result of determining this sudden rise in the condensing temperature, the controller may determine to switch the reversing valve to the first mode to initiate the heating of the equipment. This sudden rise in temperature (e.g., about a 10° C. increase) is because the frost stops changing phase from ice to liquid, as the energy required to melt ice is about 20 times higher than it is to raise the temperature of the water left on the surfaces (e.g., surfaces 116) of the evaporator. Thus, the controller detects the temperature and pressure of the refrigerant climbing quickly when the frost/ice is gone and determines to switch the reversing valve to the first mode to initiate the heating of the equipment. In an embodiment, operation 318 may further represent the controller turning a speed (RPM) of a motor of the compressor down and then switch the reversing valve to the first mode to initiate the heating of the equipment.

Conclusion

Although the subject matter has been described in language specific to structural features and/or methodological acts, it is to be understood that the subject matter defined in the appended claims is not necessarily limited to the specific features or acts described. Rather, the specific features and acts are disclosed as example forms of implementing the claims.

What is claimed is:

1. A heater system for heating a piece of equipment, the heater system comprising:

a reversing valve including:
- a first refrigerant inlet,
- a first refrigerant outlet,
- a second refrigerant inlet, and
- a second refrigerant outlet;

a refrigerant compressor including:
- a third refrigerant outlet coupled to the first refrigerant inlet, and
- a third refrigerant inlet coupled to the first refrigerant outlet;

a condenser including:
- a fourth refrigerant inlet coupled to the second refrigerant outlet,
- a fourth refrigerant outlet,
- a coolant outlet coupled to the piece of equipment, and
- a coolant inlet coupled to the piece of equipment;

an electric resistance heater coupled between the coolant outlet and the piece of equipment;

an evaporator including:
- an evaporator inlet coupled to the fourth refrigerant outlet, and
- an evaporator outlet coupled to the second refrigerant inlet; and a controller for causing the reversing valve to operate between a first mode in which the piece of equipment utilizes a refrigerant, circulating in a first direction and heated via the evaporator, to maintain the piece of equipment within a desired temperature range, and a second mode in which the evaporator utilizes the refrigerant, circulating in a second direction opposite the first direction and heated via the piece of equipment, to defrost the evaporator, wherein the controller is configured to control the electric resistance heater to heat a coolant circulating between the condenser and the piece of equipment to maintain the piece of equipment within the desired temperature range in the second mode.

2. The heater system of claim 1, wherein the controller causes the reversing valve to operate between the first mode and the second mode based at least in part on a heating capacity of the condenser.

3. The heater system of claim 1, wherein the coolant comprises an engine coolant of a reciprocating engine of the piece of equipment.

4. The heater system of claim 1, further comprising a refrigerant liquid line coupled between the fourth refrigerant outlet and the evaporator inlet, the refrigerant liquid line having an internal volume associated with an internal volume of the evaporator to minimize flooding the condenser in the second mode.

5. The heater system of claim 1, wherein the evaporator comprises a plurality of fins having a fin density of 10 fins per inch to minimize the controller causing the reversing valve to operate in the second mode to defrost the evaporator and increase a runtime of the piece of equipment between defrosts.

6. The heater system of claim 1, wherein the piece of equipment comprises a vehicle or a generator.

7. The heater system of claim 1, wherein the refrigerant circulating in the second direction is heated via an engine oil of a reciprocating engine of the piece of equipment to defrost the evaporator.

8. The heater system of claim 1, wherein the refrigerant circulating in the second direction is heated via an engine coolant of a reciprocating engine of the piece of equipment to defrost the evaporator.

9. The heater system of claim 1, further comprising:

a first sensor associated with the coolant inlet of the condenser;

a second sensor associated with the coolant outlet of the condenser; and the first sensor and second sensor configured to monitor a change in temperature of a coolant through the condenser;

wherein the controller causes the reversing valve to operate in the second mode based at least in part on the change in temperature of the coolant.

10. A heater system for heating a piece of equipment, the heater system comprising:

a reversing valve;

a refrigerant compressor fluidly coupled to the reversing valve;

a condenser fluidly coupled to the reversing valve, an evaporator, and the piece of equipment;

the evaporator fluidly coupled to the condenser and the reversing valve;

a first sensor associated with a coolant inlet of the condenser;

a second sensor associated with a coolant outlet of the condenser, the first sensor and second sensor configured to monitor a change in temperature of a coolant through the condenser; and a controller configured to cause the reversing valve to operate between a first mode and a second mode, wherein:

in the first mode, the piece of equipment utilizes a refrigerant, circulating in a first direction and heated via the evaporator, to maintain the piece of equipment within a desired temperature range, in the second mode, the evaporator utilizes the refrigerant, circulating in a second direction opposite the first direction and heated via the piece of equipment, to defrost the evaporator, and the controller causes the reversing valve to operate in the second mode based at least in part on the change in temperature of the coolant.

11. The heater system of claim 10, wherein the controller is configured to cause the reversing valve to operate between the first mode and the second mode based at least in part on a heating capacity of the condenser.

12. The heater system of claim 10, further comprising a heater coupled between a coolant outlet of the condenser and the piece of equipment, the heater being configured to heat a coolant circulating between the condenser and the piece of equipment to maintain the piece of equipment within the desired temperature range in the second mode.

13. The heater system of claim 12, wherein the coolant comprises an engine coolant of a reciprocating engine of the piece of equipment.

14. The heater system of claim 10, further comprising a refrigerant liquid line coupled between the condenser and the evaporator, the refrigerant liquid line having an internal volume which when added to the internal volume of the condenser, roughly equals the internal volume of the evaporator to minimize flooding the condenser in the second mode.

15. The heater system of claim 10, wherein the evaporator comprises a plurality of fins having a fin density of 10 fins per inch to minimize the controller causing the reversing valve to operate in the second mode and increase a runtime of the piece of equipment between defrosts.

16. A heater system, comprising:

a reversing valve;

a refrigerant compressor fluidly coupled to the reversing valve;

a condenser fluidly coupled to the reversing valve, an evaporator, and a reciprocating engine;

the evaporator fluidly coupled to the condenser and the reversing valve;

an electric resistance heater coupled between a coolant outlet of the condenser and a piece of equipment; and a controller for causing the reversing valve to operate between a first mode and a second mode, wherein:

when the controller causes the reversing valve to operate in the first mode, the reciprocating engine utilizes a refrigerant, circulating in a first direction and heated via the evaporator, to maintain the reciprocating engine within a desired temperature range, when the controller causes the reversing valve to operate in the second mode, the evaporator utilizes the refrigerant, circulating in a second direction opposite the first direction and heated via the reciprocating engine, to defrost the evaporator, and the controller causes the electric resistance heater to heat a coolant circulating between the condenser and the piece of equipment to maintain the piece of equipment within the desired temperature range in the second mode.

17. The heater system of claim 16, further comprising a refrigerant liquid line coupled between a refrigerant outlet of the condenser and an inlet of the evaporator, the refrigerant liquid line having an internal volume when added to the internal volume of the condenser effectively matches an internal volume of the evaporator to minimize a possibility of flooding the condenser when the controller causes the reversing valve to operate in the second mode to defrost the evaporator.

18. The heater system of claim 16, wherein the evaporator comprises a plurality of fins having a fin density of 10 fins per inch to minimize the controller causing the reversing valve to operate in the second mode to defrost the evaporator and increase a runtime of the piece of equipment between defrosts.

19. The heater system of claim 16, further comprising:

a first sensor associated with a coolant inlet of the condenser;

a second sensor associated with a coolant outlet of the condenser; and the first sensor and second sensor configured to monitor a change in temperature of the coolant through the condenser;

wherein the controller causes the reversing valve to operate in the second mode based at least in part on the change in temperature of the coolant.

20. The heater system of claim 16, wherein the refrigerant circulating in the second direction is heated via an engine coolant of the reciprocating engine to defrost the evaporator.

* * * * *